US005392856A

United States Patent [19]

Broussard, Jr. et al.

[11] Patent Number: 5,392,856

[45] Date of Patent: Feb. 28, 1995

[54] SLICKLINE SETTING TOOL AND BAILER BOTTOM FOR PLUGBACK OPERATIONS

[75] Inventors: Jake W. Broussard, Jr., Lafayette; Partick Broussard, Baton Rouge, both of La.

[73] Assignee: Downhole Plugback Systems, Inc., Broussard, La.

[21] Appl. No.: 134,254

[22] Filed: Oct. 8, 1993

[51] Int. Cl.[6] ..... E21B 33/132

[52] U.S. Cl. ..... 166/285; 166/66.4; 166/169

[58] Field of Search ..... 166/66.4, 65.1, 169, 166/165, 380, 387, 202, 192, 181, 285

[56] References Cited

U.S. PATENT DOCUMENTS

| | | | |
|---|---|---|---|
| 2,141,179 | 12/1938 | Ennis | 166/65.1 X |
| 2,161,557 | 6/1939 | Clark . | |
| 3,079,997 | 3/1963 | Blydorp | 166/202 X |
| 3,105,549 | 10/1963 | Raulins . | |
| 3,105,550 | 10/1963 | Ehlert . | |
| 3,373,817 | 3/1968 | Cubberly, Jr. et al. . | |
| 3,665,955 | 5/1972 | Conner, Sr. . | |
| 3,692,106 | 9/1972 | Basham et al. | 166/169 X |
| 3,709,296 | 1/1973 | Glenn, Jr. | 166/169 X |
| 3,891,034 | 6/1975 | Owen et al. | 166/202 X |
| 4,739,829 | 4/1988 | Brunner | 166/169 X |
| 4,796,708 | 1/1989 | Lembcke | 166/386 |
| 5,188,172 | 2/1993 | Blount et al. | 166/64 |

OTHER PUBLICATIONS

Schlumberger Well Services, Houston, Tex.

Advertisement, HPI, "Non-Explosive Plugback Operation".

*Primary Examiner*—Hoang C. Dang

*Attorney, Agent, or Firm*—Browning, Bushman, Anderson & Brookhart

[57] ABSTRACT

A setting tool and a bailer bottom tool are provided for forming a wellbore plugback operation of the type used in hydrocarbon recovery operations. Each of the setting tool and the bailer bottom tool include a battery pack for powering an actuating device to actuate the respective tool downhole, thereby avoiding the risks and costs associated with mechanical jarring devices, explosive charges, and devices activated by transmitting signals to the downhole tool through an electrically conductive cable. Each tool may be biased by a spring to a release position, and the actuating device may release compressed fluid from the tool to the wellbore, thereby allowing movement of a piston member and corresponding movement of a mechanical release device for moving the tool to a release position. A trigger mechanism electronically in series between the battery power source and the actuating device may be a programmable timer or a motion sensitive timer.

9 Claims, 2 Drawing Sheets

SLICKLINE SETTING TOOL AND BAILER BOTTOM FOR PLUGBACK OPERATIONS

FIELD OF THE INVENTION

The present invention relates to equipment and techniques suitable for wellbore plugback operations of the type commonly performed in the hydrocarbon recovery industry. More particularly, the present invention is directed to relatively low cost yet reliable equipment and techniques for setting a bridge plug in a wellbore, and for thereafter plugging a portion of the well with a bridging material to enhance the recovery of hydrocarbons.

BACKGROUND OF THE INVENTION

Those skilled in the hydrocarbon recovery operations have long recognized that plugback operations can enhance the recovery of oil and gas from wells. A water channel in a downhole formation may migrate over time to the wellbore, so that the water content of the fluids recovered at the surface becomes too high. A portion of the well above and below the water channel entry to the wellbore may thus be plugged in a workover operation, and hydrocarbons thereafter may again be economically recovered by perforating another zone. Wellbore plugback operations are also used for zone isolation purposes. Plugback operations are typically performed by utilizing a downhole setting tool to first set a bridge plug, then utilizing a dump bailer to release the bridging material, such as cement, onto the bridge plug.

U.S. Pat. No. 2,161,557 discloses an early type of wellbore fluid sampler including a biased valve which may be activated in response to a downhole clock. The sampling assembly includes batteries within the tool which allow movement of sampler components during a sequencing operation, after which the tool and sampled fluid are retrieved to the surface. U.S. Pat. No. 3,105,549 discloses a downhole tool containing an explosive charge which may be activated by a permanent magnet selectively positioned within the downhole tubular string. U.S. Pat. No. 3,105,550 discloses a magnetically activated well tool which may be suspended in the wellbore from a wireline. The tool may be used to introduce an inhibitrator fluid into the well, to perforate the tubing, or to set well completion or flow control equipment.

U.S. Pat. No. 3,373,817 discloses a technique for selectively releasing a cable-suspended tool. The releasing tool may be activated either in response to tension transmitted through the cable to the tool, or in response to an electrical signal transmitted from the surface through the cable to the tool. U.S. Pat. No. 3,665,955 discloses a control valve system for terminating the flow of oil and gas during a well blowout. The system includes downhole batteries which power an electric motor and drive gear assembly to close a ball valve. U.S. Pat. No. 4,796,708 discloses a safety valve for a well which is responsive to electromatic waves transmitted from the surface to the tool for opening and closing the valve. The downhole assembly includes an electric motor actuated by downhole batteries, with the motor and actuator being operable to open and close the safety valve. U.S. Pat. No. 5,188,172 discloses a downhole control valve assembly including a battery and a clock. The system also includes pressure and temperature sensors which may be placed in the wellbore above and below the valve for taking wellbore measurements.

Three types of tools are in common use today for performing plugback operations, and each type has significant disadvantages which have limited their use in the hydrocarbon recovery industry. The efficient recovery of hydrocarbons from the depleted wells and from wells having significant water intrusion has thus long demanded a reliable yet low cost technique for performing a plugback operation to plug in or close off a portion of a wellbore.

One type of well plugback tool utilizes a jarring action to mechanically activate or set a bridge plug, and subsequently utilizes a similar jarring action to release the plugging material from the dump bailer. The work string may thus be moved axially up and down to create the jarring action which is intended to activate the setting tool and the bailer. This jarring action may also be performed on a wireline suspended tool by jerking up on the wireline, and by releasing the wireline to land the tool on a hard bottom member. These jarring action techniques have generally proven to be unreliable, and thus are disfavored for most plugback operations by experienced hydrocarbon recovery operators. Downhole tools which rely upon a jarring motion for actuation often need a member within the wellbore to serve as a hard bottom, so that the jarring tool may strike this hard bottom to perform the desired jarring action. Additional time and expense are inherently required to position such a hard bottom in a wellbore at the desired location.

A second type of tool utilized in plugback operations activates the bridge plug and the dump bailer in response to an explosive charge. The bridge plug may thus be lowered to a selected depth from a wireline, and a blasting cap electronically activated to cause the setting of the bridge plug. The dump bailer similarly may thereafter be lowered to a location slightly above the set bridge plug, and the cement in the bailer released or dumped in response to the explosive force of a blasting cap, which may shear a pin to allow for axial movement of a mandril. Blasting caps and other explosive devices used in downhole operations are inherently considered hazardous, and accordingly should be used only by experienced personnel who have been specially qualified for these operations. The high cost of the regulations involving the transportation and use of such explosive equipment, and the risks inherently associated with these explosive devices, have thus severally limited the use of this technology for performing plugback operations.

A third type of tool utilizes a wireline to transmit an operating or activating current from the surface to the downhole setting tool and, subsequently, to the downhole bailer. The electrically transmitted operating current may activate a valve to release trapped fluid within the tool, thereby allowing a spring to activate the tool and either set the bridge plug, or release the bridging material from the dump bailer. Wireline setting operations are generally considered safe and reliable, although conductive wireline operations are also expensive. In some cases, plugback operations can be economically performed utilizing an electric wireline extending from the surface to the tool, particularly when a wireline logging tool has already been used to determine the water channeling point to the wellbore, and is thus at the well site. In many other cases, however, a wireline tool is not required to determine the water channeling point. Most conductive wireline service companies require their personnel on site during an electric wireline plugback operation, thereby significantly increasing costs. Accordingly, the widespread use of plugback operations has been limited, particularly in those instances where conductive wireline equipment and personnel are not otherwise required at the well site during the plugback operation. Many low or medium capacity hydrocarbon production wells are not being efficiently operated because of the unreliability, risks, or high costs associated with the plugback operation.

The disadvantages of the prior art are overcome by the present invention, and improved tools and techniques are hereinafter disclosed while performing a plugback operation. More particularly, the present invention discloses the reliable, safe, and comparatively inexpensive technique for reliably setting a bridge plug and/or releasing a bridging material from a dump bailer.

SUMMARY OF THE INVENTION

The present invention includes a downhole setting tool and a dump bailer tool, each of which is useful to perform a wellbore plugging operation. Each tool is activated in response to a triggering mechanism which transmits electrical energy from a battery pack to a valve, which is activated to release hydraulic fluid and thereby allow a biasing member to activate the tool. Most importantly, the tools of the present invention are highly reliable, and do not utilize either an explosive charge or the transmission of an operating or actuating signals through an electric wireline extending downhole to the tool, so that the tools of the present invention may be economically suspended in a wellbore from a non-conductive cable or slickline.

In a suitable embodiment, a triggering mechanism releases power from a battery pack, which then operates a valve to release fluid from the tool and allow activation of the tool in response to a biasing member. The triggering mechanism may be a downhole clock, or a motion sensitive timer and delay mechanism. Alternatively, the triggering mechanism may be a downhole switch responsive to surface generated electro-magnetic waves, which in turn are generated when a mechanical odometer at the surface measures when the desired length of slickline has been lowered into the wellbore. The set umbrella bridge plug may be vented or nonvented, and acts as a base for the bridging material, which may comprise sand, cement, or an organic resin material for forming the downhole plug.

The dump bailer tool may be of the gravity type, wherein the weight of the bridging material allows the plug material to be released when the tool is activated to open a discharge port. The triggering mechanism, the control valve for dumping the hydraulic fluid, and the battery pack are each positioned below the bridging material storage housing of the dump bailer tool. The dump bailer may be used in conjunction with the setting tool described in this application, but may also be used in conjunction with a conventional bridge plug setting tool. Setting of a bridge plug may not be necessary if the bridging material is to be placed in the wellbore bottom below the perforated zone, or below the zone to be perforated.

It is an object of the present invention to provide improved techniques for performing a plugback operation, and more particularly for setting a bridge plug and/or for activating a dump bailer.

Another object of this invention is to provide an improved plugback operation which does not rely upon explosive charges, an electric wireline, or a downhole jarring action.

It is a feature of the invention that the setting tool and the dump bailer tool as disclosed herein may each be used in conjunction with or separate from the other tool. To obtain a high level of accuracy for a plugback operation, a conventional wireline setting tool may thus be used to set a bridge plug, and the dump bailer tool of the present invention may be utilized to economically place the downhole plug above the set bridge plug.

A further feature of the present invention is that each of the setting tool and dump bailer tool may provide a balanced fluid system within the tool, so that varying fluid pressure and temperature within the wellbore when lowering the tools in place and during the plugback operation do not affect the reliable operation of the tool.

A significant advantage of the present invention is the reduced costs incurred to reliably perform a plugback operation, since specially trained personnel familiar with explosive devices and expensive wireline equipment are not required to perform the bridge plug setting or dump bailer activation operations.

Another advantage of this invention that the plugback operation tools may utilize components which have been reliably tested under various conditions in downhole operations.

Yet a further advantage of the present invention is that various triggering mechanisms may be used to initiate activation of the plugback operation tools. Accordingly, each tool may be easily modified to include a particular triggering mechanism desired for a particular set of wellbore conditions.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
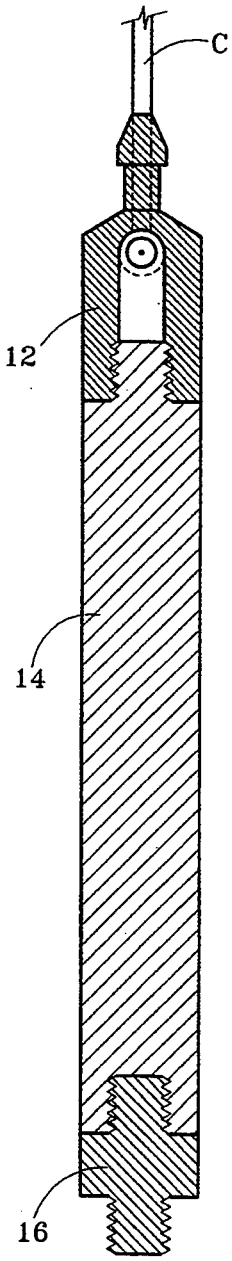
FIG. 1 is a vertical cross-sectional view of a cable-head and sinker bar which may be used in both the bridge plug setting tool and the dump bailer tool of the present invention.
Figure 2:
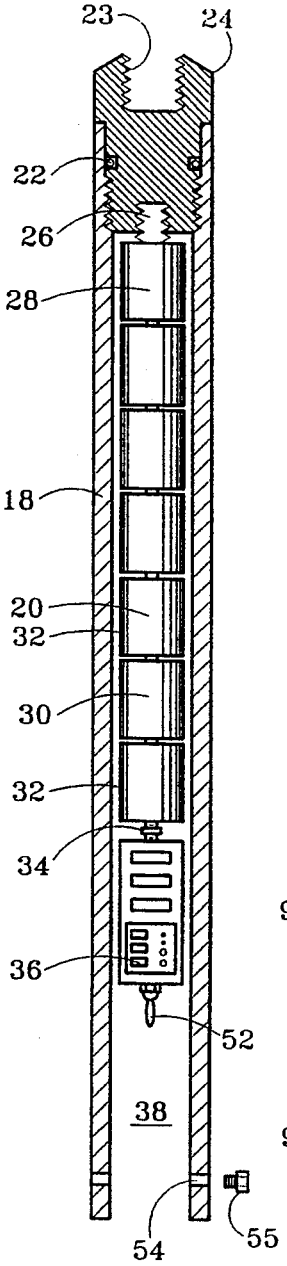
FIG. 2 is a vertical cross-sectional view of a portion of the plugback operation setting tool and the dump bailer tool, illustrating a triggering mechanism and a battery pack.
Figure 3:
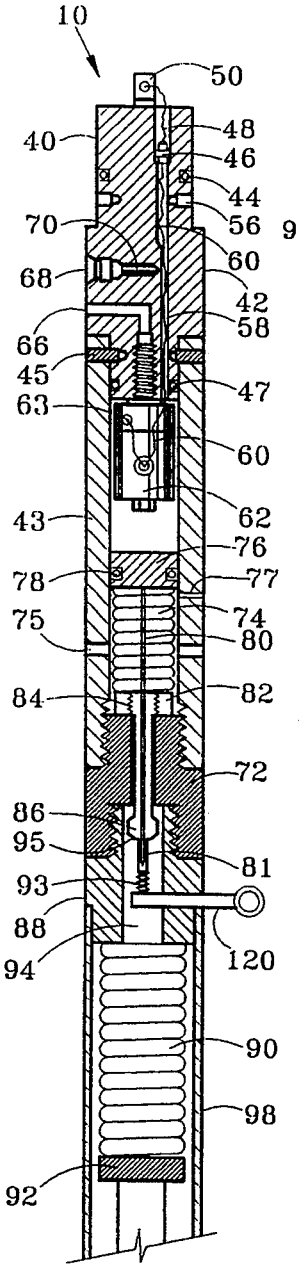
FIG. 3 is a vertical cross-sectional view of another portion of a plugback operation setting tool prior to the bridge plug setting operation.

FIGS. 1–4 depict one embodiment of an electro-hydraulic setting tool according to the present invention. Those skilled in the art will readily appreciate that the lower portion of FIGS. 1 and 2 are each connectable to the upper portion of FIGS. 2 and 3, respectively, and that the outer body of the lower portion of FIG. 3 is structurally the same as the outer body of the upper portion of the FIG. 4. Before describing this setting tool in further detail, it should again be noted that the present invention comprises a setting tool as shown in FIGS. 1–4, a bailer bottom tool for releasing a plugging material as described subsequently, and a method of performing a plugback operation according to the present invention also as described below.

The setting tool 10 includes an upper slickline cablehead 12, which allows the tool 10 to be connected to a slickline suspension cable C. Those skilled in downhole tools appreciate that the slickline suspension line C need not be conductive according to the present invention, and accordingly the cost of utilizing a non-conductive cable for lowering and raising the tool 10 within a wellbore is substantially reduced compared to an electrically conductive wireline operation. The solid steel bar 14 is suspended from cablehead 12 by a conventional threaded connection, and the axial length of bar 14 may be easily adjusted to ensure sufficient weight for the tool to be lowered and raised within a particular wellbore. It should be understood that the weight of the sinker bar 14, in combination with the remainder of the tool 10, limits upward movement of the tool string when the plug is set.

A double pin threaded connector sub 16 may thus be used to interconnect the lower end of weight bar 14 and the plug sub 24. The interior of the power source sub or hanger sub 18 is sealed from the environment within the wellbore, and sub 18 is a ground connection for the battery pack 20 contained therein. O-ring 22 thus seals between the sub 18 and the plug sub 24, which is threadedly connected to the hanger sub 18. A spring biased contact 26 provides a ground connection to the upper battery 28, and thereby also provides the ground connection to each of the lower batteries 30. Each of the batteries in the battery pack 20 are thus placed within a chamber 38 within the sub 18, and the chamber may be lined with a fiberglass, phenolic, or ceramic tube 32 to increase the reliability of the electrical system in response to temperature fluctuation and high temperature environments commonly experienced in downhole wells. The batteries which comprise the battery pack 20 may be either alkaline or lithium batteries, depending upon the anticipated downhole environment to which the tool 10 will be subjected. Battery pack 20 rests upon spring biased contact 34, which is electrically connected to the trigger mechanism 36, which for purposes of this description may be assumed to be a timer mechanism. If desired, the trigger mechanism may be isolated from the chamber which contains the battery pack 20 by utilizing a tandem pin sub (not shown) for sealing between the battery pack and the trigger mechanism, and such sealing isolation is generally recommended when using lithium batteries.

The trigger mechanism 36 comprises programmable 0–24 hour LED electronic solid state timer. Those skilled in the art will understand that such timers are commercially available and are commercially used in downhole tools. Instead of being a programmable 0–24 hour timer, the timer may be a motion sensitive clocking device. The motion sensitive timer may have a feature which allows the timer to be reset to zero time in response to motion of the tool 10. According to one embodiment, when the tool 10 is stationary for a preselected period of time within the borehole, the clock mechanism will start, and after a selected time period from the zero time start, e.g., five minutes, the timer mechanism will call for the circuit to "fire", releasing energy from the battery pack. A mechanical timing device may also be used. The trigger mechanism 36 as shown in FIG. 2 is also housed within the tube 32, allowing the battery pack and the trigger mechanism to be easily programmed and then returned into the chamber 38 within the hanger sub 18. The trigger mechanism is electronically (and physically) between the power source and the actuating device 62.

The reduced diameter upper end 40 of the sub housing 42 as shown in FIG. 3 may thus be positioned within the chamber 38 as shown in FIG. 2, with the 0-ring 44 providing sealed engagement between the hanger sub 18 and the housing sub 42. The hanger sub 18 thus provides a sealed housing to ensure proper isolation of the battery pack from the downhole environment. The spring loaded contact 34 provides an electrical connection to the timer mechanism 36 for the DC power from the battery pack. A plug member 46 is sealingly positioned with passageway 48 within the sub housing 42, with the plug member 46 being electrically connected to a female brass contact receptacle 50, which electrically mates with male banana plug 52 at the lower end of the trigger mechanism 36 to ensure proper electrical connection between the trigger mechanism and the electronically powered actuating device or coil assembly 62 discussed below. Receptacle 50 is electrically isolated from the housing sub 42, and includes a coil wire contact. The plug 46 thus has a threaded end for engagement with the sub housing 42, and includes a ceramic body for proper isolation of hydraulic oil below the plug 46 from the battery pack 20, which serves as a power source to transmit power to the coil assembly 62.

Figure 6:
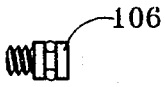
FIG. 6 is a pictorial view of a filler hole plug which may be used in the plugback operation tools of the present invention.

Circumferentially spaced ports 54 in the hanger sub 18 and ports 56 in the sub housing 42 may be aligned so that the respective set screws 55 as shown in FIG. 2 interconnect the housings. A wire or other electrical conductor 60 electrically connects the plug 46 with coil assembly 62. The wire 60 and hydraulic oil thus occupy the passageway 58 below the sub 46. Chamber 64 within the sub housing 42 is filled with hydraulic fluid, and the coil assembly 62 may be activated as explained below to release the oil from the chamber 64 to the downhole environment through dump port 66. The hydraulic fluid may be input to the chamber 64 through fill hole 68. After the chamber 64 is filled, hole 68 is closed off by check valve 70, and with a backup plug as shown in FIG. 6.

Housing 43 as shown in FIG. 3 is fixedly connected to housing sub 42 by hex head screws 45, and serves as an actuating tool housing. Coil spring 74 is compressed when the chamber 64 is filled with pressurized fluid, and thus biases piston 76 upward. Piston 76 is sealed to the lower portion of the housing 43 by 0-ring 78, and upward movement of the piston 76 is prevented since the chamber 64 is sealed until the coil assembly 62 is activated, and since the fluid within the chamber 64 is, for practical purposes, incompressible. Rod 80 is fixed at its upper end to the piston 76, and extends through the retainer ring 82 and then through the latch sub 72. Ring 82 includes a threaded port 84 to receive the upper end of collet mechanism 86, and cooperates with the collet mechanism 86 to retain the rod 80 in its run-in position or stop position as shown in FIG. 3, i.e., before the setting tool is set. The lower end 81 of rod 80 thus engages a plurality of finger collets 86, which are housed within the plug latch tube upper end 95 of the downwardly projecting rod 94. Finger collets 86 are prevented from radially inward movement by the lower end of rod 80, and thus maintain the lower rod 94 in the position as shown in FIG. 3, thereby maintaining the bridge plug inside its setting sleeve prior to actuation of the tool 10.

Housing sub 88 is threadably connected to latch sub 72, and housing 88 is similarly connected to the lower end of sub 72. Housing 88 provides a chamber for receiving spring 90. The top of spring 90 is welded otherwise fixedly connected to the housing 88, and the bottom end of the spring 90 rests on thrust washer 92, which in turn is welded to the plug rod 94, so that the spring 90 provides for biased ejection of the bridge plug, while washer 92 provides for proper alignment during this operation.

The sleeve 98 provides protection for the umbrella bridge plug BP, and retains the plug BP in its compact position prior to setting the umbrella bridge plug BP. The bull plug 97 at the lower end of the umbrella bridge plug BP provides for proper guiding of the plug BP out of the sleeve 98. Sleeve 98 is interconnected with the housing 88 and houses the bridge plug BP. Clamping device 100 shown at the lower end of the sleeve 98 is discussed subsequently.

The housing 42 is sealed at both ends for isolation from the wellbore, and the interconnected actuating tool housing 43 provides a housing for the coil assembly 62, and a sealed chamber for the oil. A plurality of circumferentially spaced hex head capscrews 45 and 55 are provided, as shown in FIG. 2 and 3, each for fitting within the respective ports for interconnecting the housings 18, 42 and 43. The weep hole 77 insures proper air bleedoff out of the reservoir by when filling chamber 64, and also provides bleed-off as the temperature fluctuations within the wellbore cause thermal expansion or contraction of the hydraulic fluid.

The piston housing 43 provides a honed interior for sealed engagement with the piston 76, and houses the spring 74 and the piston 76. The spring 74 thus biases the collet rod 80 upward toward the bar 14. Port hole 75 in sub 43 provides fluid communication of wellbore fluids and the chamber receiving the spring 74 to create the desired balanced system for the tool 10, as explained subsequently. Coil assembly 62 may be ground by grounding wire screw 63 to ensure proper electrical operation of the coil assembly. The coil assembly 62 houses a solenoid valve with a plunger (not shown) which seals a dump port 66 from the chamber 64 until the coil assembly is activated.

The lower portion of the tool 10 thus includes the setting apparatus, with the umbrella bridge plug BP being provided within the setting sleeve 98. Fluid may be input to the chamber 64 through the port 68 using an oil can, an Enerpac hydraulic oil filler, or another fluid pump or other mechanisms suitable for filling the chamber 64 within a downhole tool, and for pressurizing the chamber 64 as discussed below. The fill hole 68 thus has a polished bore for sealing with the external housing of the check valve 70.

Figure 4:
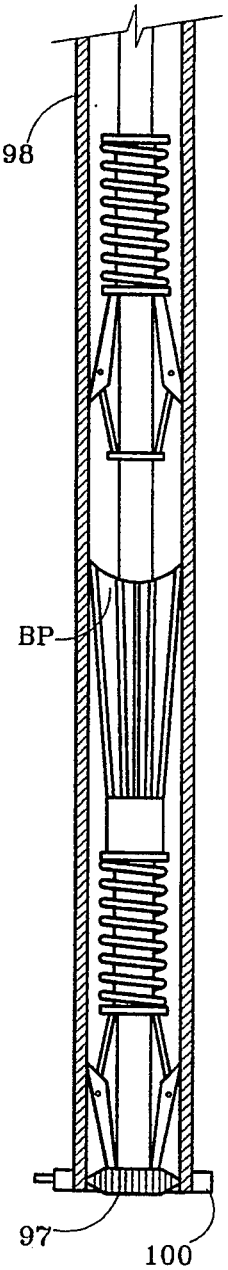
FIG. 4 is a vertical cross-section view of a lower portion of a plugback operation setting tool, showing the umbrella bridge plug within the setting sleeve.
Figure 5:
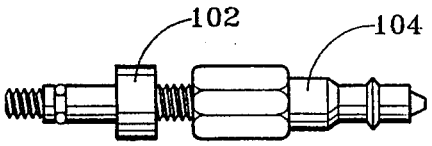
FIG. 5 is a pictorial view of a oil filler attachment device for use in both the bridge plug setting tool and the dump bailer tool according to the present invention.

Referring to FIG. 5, a suitable oil filler attachment 104 and a filler oil screw 102 are depicted. The fill hole 68 may initially be sealed with a suitable check valve 70. Attachment 104 may be provided at the end of a flexible hose for a hydraulic fluid pump, and transmits oil through the filler hole screw 102, which is removably sealed to the housing sub 42 during the oil filling process. After filling the chamber 64 with hydraulic oil, a back-up plug 106 as shown in FIG. 6 may be inserted in fill hole 68 to duplicate the isolation of the chamber 64 from the exterior of the tool. The umbrella bridge plug BP is thus in its compact or unset position while within the sleeve 98, and is held in this position by the axial position by the rod 94 as shown in FIG. 3. The operator must thus remove the clamp 100 from the position as shown in FIG. 4, or remove the pin 120 if provided, so that the bridge plug BP may be set after the tool is lowered into the wellbore.

Figure 7:
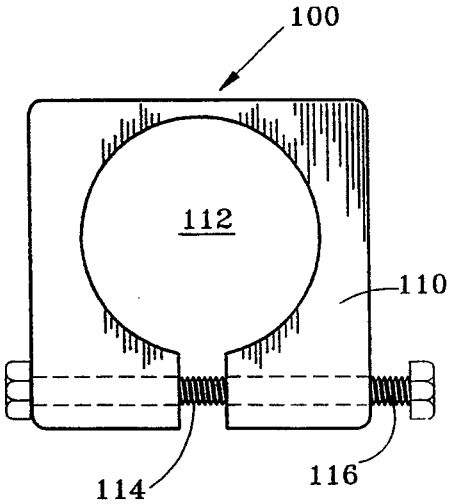
FIG. 7 is a pictorial view of a clapping mechanism which may be used in conjunction with the plugback operation setting tool.

The clamp 100 generally shown in FIG. 4 is shown in greater detail the FIG. 7, and includes a generally C-shaped body 110 defining cylindrical passageway 112 therein. The C-shaped body has an open throat portion 114, and the diameter of the cylindrical passageway 112 may be effectively controlled by tightening or loosening the bolt or other suitable member 116 to open or close spacing of the throat 114. Retainer lock clamp 100 may thus be secured in the position at the end of the sleeve 98 as shown in FIG. 4, and bolt 116 tightened to prevent expansion of the sleeve 98 and thus discharge of the umbrella bridge plug BP from the sleeve. Those skilled in the art will appreciate that another type of safety device, such as a pin 120 as shown in FIG. 3, may be used to prevent inadvertent axial movement of the rod 94 within the housing 88, thereby preventing discharge of the umbrella bridge plug BP from the sleeve 98.

A suitable coil assembly 62 includes a stainless steel plunger insert and a 12 volt DC coil. The coil assembly includes a suitable two-way Type B2 solenoid valve (not shown), and is manufactured by the Honeywell Skinner Valve Division. A suitable bridge plug BP is a through-tubing bridge plug BP manufactured by The Halliburton Company, and the Model 163 HIP plug is particularly well suited for the purposes of the present invention.

During assembly of the tool, the umbrella bridge plug BP is thus placed into its setting sleeve 98, and the spring 90 compressed. Clamp 100 is placed about the lower end of the sleeve 98 for cooperating with the plug rod 94 to safely hold the umbrella bridge plug BP in the setting sleeve 98 while the spring 90 is under compression. Spring 90 is welded to the bottom of the top sub 88, and rests freely on the washer 92. The filler sub attachment as shown in FIG. 5 is then threaded into the housing sub 42, and hydraulic fluid is pumped into the fill hole 68 and through the check valve 70, then through the passageway 58 and to the chamber 64. Once the chamber 64 and its interconnected reservoirs are filled with hydraulic fluid, continued injection of pressurized fluid will move the piston 76 and thus the collet rod 80 connected thereto downward, simultaneously compressing the spring 74. The piston 76 will travel downward a selected distance of approximately five to ten centimeters, whereupon further fluid injection causes fluid to be expelled out of the weep hole 77. At this stage, the piston 76 and the collet rod are at their desired placement for their stroke.

The lower end 81 of piston rod 80 expands the collet mechanisms 86, so that the clamp mechanism 100 or the pin 120 can be safely removed without ejection of the umbrella plug BP from the setting sleeve 98. The filler sub attachment as shown in FIG. 5 may then be removed and replaced with the threaded O-ring seal cap screw or plug, as shown in FIG. 6. The triggering mechanism, such as the electronic timer 36 as shown in FIG. 2, is then ready to be programmed to the desired actuation time. The battery pack 20 and the triggering mechanism 36 may be inserted into the chamber 38. The tube 32 may include a window cut for accessible programming. The batteries and the trigger mechanism may be held inside the tube 32 by a suitable lock ring (not shown) mounted on each end.

After the triggering mechanism has been programmed and installed in the chamber 38, the assembly as shown in FIG. 2 may be connected to the valve housing sub 42, and is sealed therewith by O-ring 44. The male banana plug contact 52 is thereby inserted into the brass female contact receptacle 50. The housing 18 may be fixedly mounted to the housing sub 42 by a plurality of hex caps screws 55. The assembly as shown in FIGS. 2, 3 and 4 may then be interconnected with the sub 16 and the bar 14, as shown in FIG. 1. The entire tool assembly as shown in FIGS. 1–4 is then ready for its descent into the wellbore, with the piston 76 in its stop position as shown in FIG. 3 for preventing axial movement of rod 94 with respect to the housing 43. After the assembly 10 reaches the desired setting depth, the triggering device 36 is actuated, and current from the battery pack 20 is applied to the coil assembly 62. Current will thus travel through contact plug 46 to reach the coil assembly 62, causing its plunger to retract from the seal, thereby allow hydraulic oil in the chamber 64 to dump through the orifice port hole 66 to the wellbore. The spring 74 pushes the piston 76 upward and toward the coil assembly 62 (to a release position), simultaneously moving the collet rod 80 up through the collet members 86, thereby allowing the collet members to close (move radially inward) and releasing the plug rod 94 so that it may move downward and thereby release the umbrella bridge plug BP into the wellbore. After the bridge plug BP is set in the wellbore, the entire tool assembly except for the bridge plug BP may then be retrieved to the surface, leaving the umbrella bridge plug BP set in the wellbore at the desired depth. The rod 94 may contain a threaded cavity 93 for receiving a standard threaded tool to facilitate transportation of the bridge plug BP while inside housing 98, and thereby prevent the inadvertent ejection of bridge plug while in transport.

Figure 8:
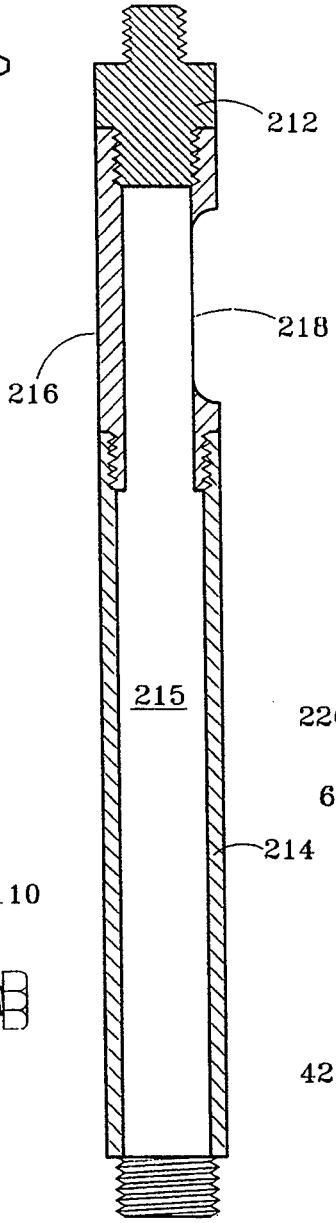
FIG. 8 is a vertical cross-sectional view of a portion of a dump bailer tool according to the present invention, illustrating particularly the housing for receiving the bridging material.
Figure 9:
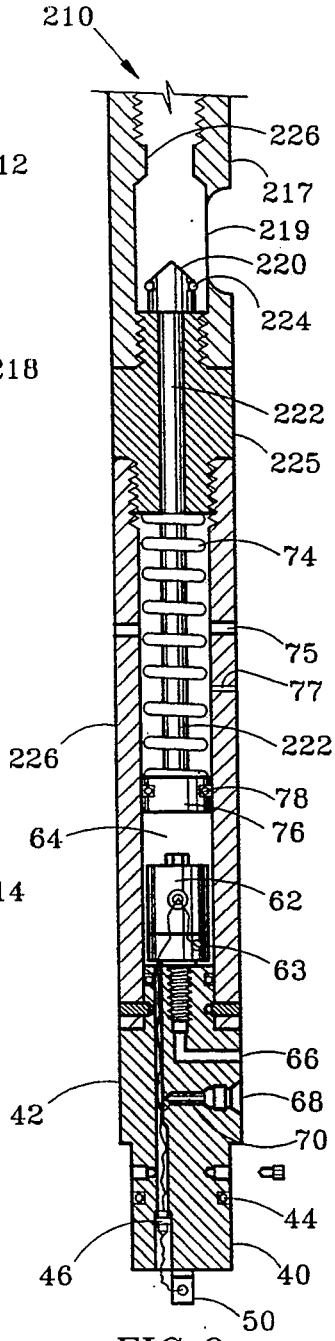
FIG. 9 is a vertical cross-sectional view of a portion of a dump bailer tool subsequent to the release of the bridging material from the tool.

Referring now to FIGS. 1, 8, 9, and 2, the bailer bottom 210 of the present invention will now be discussed. Dump bailer 214 comprises an upper member which may be the same as the components shown in FIG. 1, with the double pin end sub 212 interconnecting the bar 14 (see FIG. 1) and the component shown in FIG. 8. The assembly as shown in FIG. 9 may be threadedly interconnected to the lower end of the assembly as shown in FIG. 8, and the assembly as shown in FIG. 2 inverted so that the lower end of the assembly as shown in FIG. 2 is interconnected with the lower portion of the assembly as shown in FIG. 9. The top portion of the assembly as shown in FIG. 2 to thus the lower terminal end of the dump bailer bottom 210, so that the battery pack 20 is now positioned below rather than above the coil assembly 62.

Those skilled in the art will appreciate that an axially long bar 14 may not be required for a dump bailer bottom 210 according to the present invention, since the substantial weight of the remaining components of the dump bailer as shown in FIGS. 8, 9, and 2, in conjunction with the weight of the plugging material within the dump bailer, may provide sufficient weight for proper decent of the tool 210 into the wellbore. FIG. 8 depicts a dump bailer portion 214 including an upper sub 216 threadedly connected to hanger sub 2 12 and having a fill window 218 for filling the interior of the dump bailer 214 with a desired plugging material. The axial length of the carrier tube 214, which is threadably connected to the sub 216, may thus be altered so that the dump bailer has a selected interior volume 215 for receiving a desired amount of plugging material.

Referring to FIG. 9, the dump bailer bottom discharge sub 217 is threadably connected to the lower end of the carrier tube 214, and includes a discharge port 219 for releasing the plugging material within the chamber 215 into the wellbore, and typically on top of the umbrella bridge plug BP. When the dump bailer bottom 210 is run into the wellbore, the plugging member 220 at the upper end of the rod 222 is in sealed engagement with the sub 217 above the discharge port 219. Accordingly, seal member 224 carried on the plug 220 is in sealing engagement with the polished seal bore 226 of the sub 217 to prevent fluid within the chamber 215 from being discharged out 219. The rod 222 passes through the double pin member 225, which is threadedly connected to the sub 217 and 226. The sub 225 thus guides the rod 222 during its axial movement. Housing 226 similarly is connected to the lower end of the member 225. The lower end of the rod 222 is fixedly connected to piston 76, as shown in FIG. 9. Most of the remaining components depicted in FIG. 9 may be structurally and functionally identical to components depicted in FIG. 3 and discussed above. Accordingly, the same reference numerals are used in FIG. 9 to refer to like components.

Referring again to FIG. 2, it should be understood that the tool as shown in FIG. 2 may be inverted, and the lower end 40 of the assembly as shown in FIG. 9 is inserted in the cavity 38, and electrical contact made between the male component 52 and the female component 50. The plurality of circumferentially spaced hexhead cap screws 55 as generally shown in FIG. 2 may thus be used to structurally interconnect the housing 18 and the housing 42 as shown in FIG. 9. Sealed engagement between the housing 42 and the housing 18 is again provided by the O-rings 44.

The apparatus as shown in FIG. 2 may thus be inverted and suspended from the portion of the tool as shown in FIG. 9, so that the battery pack 20 is below the triggering mechanism. The sub 24 may be identical to the member 24 as shown in FIG. 2, with its terminal end threaded for engagement with a guide sub (not shown) to be suspended from the bailer bottom. Alternatively, the sub 24 may only include threads lower for engagement with housing 18 above sub 24, and the threaded pocket 23 at the lower end of the tool need not be provided.

To prepare the bailer bottom of the present invention for decent into a wellbore, hydraulic fluid may be pumped to fill the chamber 64 as previously described. It should be understood that after pressurization the chamber 64 will be substantially larger than as shown in FIG. 9, since the plug 220 and piston 76 will be moved upward and axially away from the coil assembly 62, i.e., to its stop position for preventing downward movement of the plug 220 by the spring 74 prior to decent of the tool in the wellbore. Continued injection of hydraulic fluid into the chamber 64 thus separates the piston axially from the coil 62 (as shown in FIG. 3), thereby compressing the helicoil spring 74. This injection of hydraulic fluid may continue until fluid is expelled from the weep hole 77, as previously explained.

The apparatus as shown in FIG. 8 may then be connected to the apparatus as shown in FIG. 9, with the plug 220 sealing with the cylindrical bore 226 so that the desired material will be trapped within the dump bailer chamber 2 15. The components of FIG. 8 and 9 may then be lowered into the hole so that the fill window 218 is easily accessible. Chamber 215 is then filled though chamber 218 with the desired bailer content material, and the components as shown in FIG. 2 then attached to the assembly of FIG. 9. The triggering device and power supply may then be set in the manner previously explained for the setting tool.

The entire dump bailer assembly as shown in FIGS. 1, 8, 9 and 2 may then be positioned for lowering into the wellbore. After the assembly 210 reaches the desired depth and the triggering device 36 as shown in FIG. 2 has been actuated, power from the battery pack 20 will be contacts 52 and 50, and then through the plug 46 as shown in FIG. 9, and finally to the coil assembly 62. Power to the coil assembly 62 will cause the plunger insert within the coil assembly to retract, allowing the hydraulic oil in the reservoir 64 to be expelled through port 66 and into the wellbore. During this action, the spring 74 pushes the piston 76 downward toward the coil housing 62 as shown in FIG. 9 to its release position, thereby pulling the plug 220 out of sealing engagement with the sub 217. Once the contents from the chamber 215 have been discharged by gravity into the wellbore, the tool 210 may be retrieved to the surface and prepared for this next run into the wellbore.

The tool 10 and the tool 210 of the present invention each is an electrohydraulic device, and more particularly presents a balanced fluid system so that pressure on the internal closed chamber 64 is the same as the external pressure within the wellbore due to the combined hydrostatic pressure and the downhole oil and gas pressure. The pressure equalization window or port hole 75 thus provides for wellbore communication, and port 75 is located at approximately the position of the spring 74, and above the chamber 64. The chamber within the tool containing the spring 74 will thus fill with fluid to create a balanced system between the wellbore fluids and the chamber 64 due to balancing effect of the piston 76. The pressure in the chamber 64 is thus a known or calculatable pressure equal to the downhole fluid pressure plus a known or calculatable force, e.g., 200 pounds, due to the additional force of the spring 74 pushing against the piston 76.

The two-way normally closed solenoid valve within the coil assembly 62 as shown in FIG. 3 may have a rating of 250 psi, and the compressive force of the spring 74 will thus create a force less than this 250 psi rating. Fluid may escape from the weephole 77 as the tool 10 or the tool 210 is run in the wellbore. As a safety precaution, to ensure that the tool 10 as shown in FIGS. 1–4 and the tool 210 as described above does stroke, each tool is built with a 25% safety stroke, i.e., the collet mechanism will normally release at about 75% of its full releasing stroke. This safety feature also prevents stroking of the tool during its accent out of the wellbore is response to the decreasing temperature, since there may not be a sufficient amount of the hydraulic fluid left in the reservoir 64 because oil has escaped during decent of the tool into the wellbore.

According to the method of the present invention, bridge plug setting tool may be assembled and lowered into a wellbore at a selected depth from a flexible line. An actuating device within the setting tool may then be triggered by the timing device in the tool, or triggered by sending electromagnetic signal to a downhole receiver adjacent the triggering mechanism. The triggering mechanism will thus release power from the battery power source to activate the actuating device, thereby releasing the bridge plug from the setting tool. Once the bridge plug has been set within the wellbore, the setting tool may be retrieved to the surface via the flexible line. As previously noted, the technique for releasing the bridging material into the wellbore on top of the bridge plug can be used regardless of the technique utilized for setting the bridge plug within the wellbore, and in some cases a bridge plug will not have to be set in a wellbore in order to properly release the bridging material to plug the well.

Assuming that the bridge plug has been set in the wellbore, the bridging material may be released from a bailer bottom tool within the wellbore for performing the plugback operation by assembling the bailer bottom tool as described herein, and suspending the tool from a flexible line at a selected depth within the wellbore, e.g., 10 meters above the set bridge plug. By activating a triggering mechanism within the bailer bottom tool, power from the downhole battery power source will be released to the downhole activating device, thereby causing unplugging of the discharge port within the bailer bottom tool and releasing the bridging material into the wellbore. Once the bridging material has been set on top of the bridge plug, the bailer bottom tool as described herein may be retrieved to the surface via the flexible line, so that the tool be prepared for its next job.

Those skilled in the art will appreciate that the term "bridging material" as used herein is intended to cover any material which is commonly used to form a plug in a wellbore, and is not limited to the exemplary materials described in this application. Those skilled in the art should also understand that the term "bridge plug" as used herein is intended to refer to any vented or non-vented plug which is mechanically set in a wellbore and serves as a base for receiving the bridging material. Various mechanical release devises other than plurality of collet members and a collet rod may be utilized for preventing the release biasing member from releasing the bridge plug within the setting tool, or from removing the plug from the bridging material discharge port in the bailer bottom tool, until the actuating device powered by the battery power source has been activated. Although not shown in the figures, it should be understood that a spring or other biasing member may be provided within the bailer bottom tool for assisting in the discharge of the bridging material from the tool after the actuating device has been activated and the plug moved from the discharge port. Biasing members other than coil springs may also be used to bias the piston member within each tool.

The various embodiments of the invention as described above and the methods disclosed herein will suggest further modifications and alternations to those skilled in the art. Such further modifications and alternations may be made without departing from the spirit and scope of the invention, which is defined by the scope of the following claims.

What is claimed is:

1. A bailer bottom tool for releasing a bridging material into a wellbore for a plugback operation, the bailer bottom tool comprising:

an upper cablehead member for suspending the bailer bottom tool from a flexible line at a selected depth within the wellbore;

a material housing affixed to the cablehead member for housing the bridging material;

a movable plug for plugging a discharge port from the material housing;

an actuating tool housing affixed to the material housing, the actuating tool housing having a cylindrical bore therein, a piston member axially movable within the actuating tool housing while in sealed engagement with the cylindrical bore, the actuating tool housing and the piston member defining a sealed chamber within the bailer bottom tool for receiving a compressed fluid, and a mechanical release device responsive to axial movement of the piston member and movable between a stop position for maintaining the movable plug in a plugging position and a release position for releasing the bridging material from the material housing;

a battery power source within the actuating tool housing;

an electronically powered actuating device within the actuating tool housing for causing the movable plug to move to a discharge position for releasing the bridging material from the material housing; and a triggering mechanism within the actuating housing electronically in series between the battery power source and the actuating device for releasing energy from the battery power source to activate the actuating device.

2. The bailer bottom as defined in claim 1, further comprising:

a release biasing member for biasing the movable plug to the discharge position for discharging the bridging material from the material housing.

3. The bailer bottom tool as defined in claim 1, further comprising:

a fluid passageway through the actuating tool housing at a position axially opposite the piston member with respect to the sealed chamber for balancing the pressure within the sealed chamber from the pressure external of the bailer bottom tool and within the borehole.

4. The bailer bottom as defined in claim 1, further comprising:

a piston spring for biasing the piston member axially in a direction to move the mechanical release device to the release position; and the mechanical release device comprises a plurality of collet members and a collet rod axially connected to the piston member.

5. The bailer bottom tool as defined in claim 1, further comprising:

the actuating device being positioned within the sealed chamber;

an electric wire within the sealed chamber for electrical interconnection with the actuating device; and a sealing plug for transmitting power from the battery power source to the electric wire while sealing the pressurized fluid within the sealed chamber.

6. The bailer bottom tool as defined in claim 1, wherein the triggering mechanism consists of one of a programmable timer and a motion sensitive timer.

7. The setting tool as defined in claim 6, wherein the triggering device is positioned axially between the battery power source and the actuating device, and is radially positioned within an electrical insulating tube.

8. A method of releasing a bridging material within a wellbore for a plugback operation, the method comprising:

suspending a material housing containing the bridging material from a flexible line at a selected depth within the wellbore;

plugging a discharge port from the material housing for preventing premature release of the bridging material from the material housing into the wellbore;

suspending an actuating tool housing from the material housing;

biasing a movable plug to an unplugged position;

providing a sealed chamber within the actuating tool housing for receiving a compressed fluid;

providing a piston axially movable within the actuating tool housing for acting on the sealed chamber;

positioning an electronically powered actuating device within the actuating housing for controlling the unplugging of the discharge port;

positioning a battery power source with the actuating housing; and activating a triggering mechanism to transmit power from the battery power source to the actuating device to release said compressed fluid from the seal chamber and unplug the discharge port and release the bridging material from the material housing and into the wellbore.

9. The method as defined in claim 8, further comprising:

positioning a bridge plug within a bridge plug setting tool;

providing a battery power source within the bridge plug setting tool;

providing a setting tool actuating device within the bridge plug setting tool, the actuating device being powered by the battery power source.

suspending the bridge plug setting tool from a flexible line at a selected depth within the borehole; and actuating the setting tool actuating device to release the bridge plug from the setting tool.

* * * * *